US006558142B2

(12) United States Patent
De Matthaeis

(10) Patent No.: US 6,558,142 B2
(45) Date of Patent: May 6, 2003

(54) HIGH-PRESSURE HYDRAULIC FUEL PUMP

(75) Inventor: Sisto Luigi De Matthaeis, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/908,715

(22) Filed: Jul. 19, 2001

(65) Prior Publication Data

US 2002/0034452 A1 Mar. 21, 2002

Related U.S. Application Data

(63) Continuation of application No. PCT/IT00/00488, filed on Nov. 29, 2000.

(30) Foreign Application Priority Data

Nov. 30, 1999 (IT) ..... TO99A1055

(51) Int. Cl.[7] ..... F04B 39/10; F04B 53/10

(52) U.S. Cl. ..... 417/562; 123/495

(58) Field of Search ..... 417/562, 570, 417/206, 273; 418/170; 123/506, 458, 495, 450; 92/129

(56) References Cited

U.S. PATENT DOCUMENTS 4,660,522 A * 4/1987 Babitzka ..... 123/450
5,626,466 A * 5/1997 Ruoff et al. ..... 417/273
5,979,297 A * 11/1999 Ricco ..... 92/129
6,129,518 A * 10/2000 Ricco ..... 417/206
6,176,223 B1 * 1/2001 Kuhn et al. ..... 123/495
6,293,253 B1 * 9/2001 Arnold et al. ..... 123/458
6,422,212 B1 * 7/2002 Faix et al. ..... 123/506
6,450,788 B1 * 9/2002 Grabert ..... 417/570
6,450,792 B1 * 9/2002 Eisenbacher et al. ..... 418/170
6,457,957 B1 * 10/2002 Bauer et al. ..... 417/562

FOREIGN PATENT DOCUMENTS

| | | |
|---|---|---|
| DE | 197 29 790 | 7/1997 |
| DE | 197 29 791 | 7/1997 |
| DE | 198 48 035 | 10/1998 |
| EP | 0 933 524 | 7/1998 |

* cited by examiner

*Primary Examiner*—Teresa Walberg
*Assistant Examiner*—L Fastovsky
(74) *Attorney, Agent, or Firm*—Merchant & Gould P.C.

(57) ABSTRACT

The pump (5) has at least one cylinder (6) in which slides a piston (16) moved positively in the compression direction and elastically in the intake direction. A compression spring (26) is located between the shutter (21) of an intake valve (19) and the piston (16) to push the shutter (21) elastically into a closed position by exerting elastic force varying according to the position of the piston (16). The shutter (21) has a plate (28) cooperating with a seat (22) on the intake valve (19) and moveable parallel to the piston (16); and the compression spring (26) acts on the plate (28) to advance both opening and closing of the intake valve (19).

10 Claims, 2 Drawing Sheets

HIGH-PRESSURE HYDRAULIC FUEL PUMP

This is a Continuation of application No. PCT/IT00/00488, filed Nov. 29, 2000.

TECHNICAL FIELD

The present invention relates to a high-pressure hydraulic pump, in particular an internal combustion engine radial-piston fuel pump.

BACKGROUND ART

As is known, in internal combustion engines, in particular diesel engines, such a pump operates at high pressure, even as high as 1,600 bars, and comprises a group of radial cylinders in which slide respective pistons activated by a common cam. Each piston has a return spring so as to move elastically during the fuel intake stroke, and is associated with an intake valve comprising a shutter which is normally kept closed by another return spring for opening the valve when overcome by the intake fuel pressure.

In one known three-radial-piston pump, each shutter has a plate cooperating with a corresponding seat in the cylinder, and is opened when the intake fuel pressure reaches roughly 5 bars; and the reaction of the three pistons on the drive shaft is normally balanced sufficiently by the 120° spacing of the pistons.

In known radial-piston pumps, the shutter return spring is unaffected by the piston position. When the pump works at low capacity, e.g. below 30% of maximum, both the drive shaft and the delivery pressure of the various cylinders are subject to unbalance. In fact, the intake valves open with a variable amount of delay, and some may even not open at all, so that the pistons compress different amounts of fuel.

DISCLOSURE OF INVENTION

It is an object of the present invention to provide a highly straightforward, reliable high-pressure hydraulic pump designed to eliminate the aforementioned drawbacks typically associated with known pumps.

According to the present invention, there is provided a high-pressure hydraulic pump comprising at least one cylinder in which slides a piston, and actuating means for moving said piston positively in a compression direction; said piston being moved elastically in an intake direction opposite to said compression direction; and an intake valve comprising a shutter being fitted to said cylinder; characterized in that elastic means are provided between said piston and said shutter to push said shutter into a closed position by exerting elastic force varying with the position of said piston in said cylinder, so as to advance opening and closing of said intake valve.

More specifically, in a pump in which the shutter comprises a plate cooperating with a seat carried by the cylinder, and the plate is movable parallel to the piston, the elastic means comprise a helical compression spring located between the plate and the piston.

BRIEF DESCRIPTION OF THE DRAWINGS

A preferred, non-limiting embodiment of the invention will be described by way of example with reference to the accompanying drawings, in which.

BEST MODE FOR CARRYING OUT THE INVENTION

Figure 1:
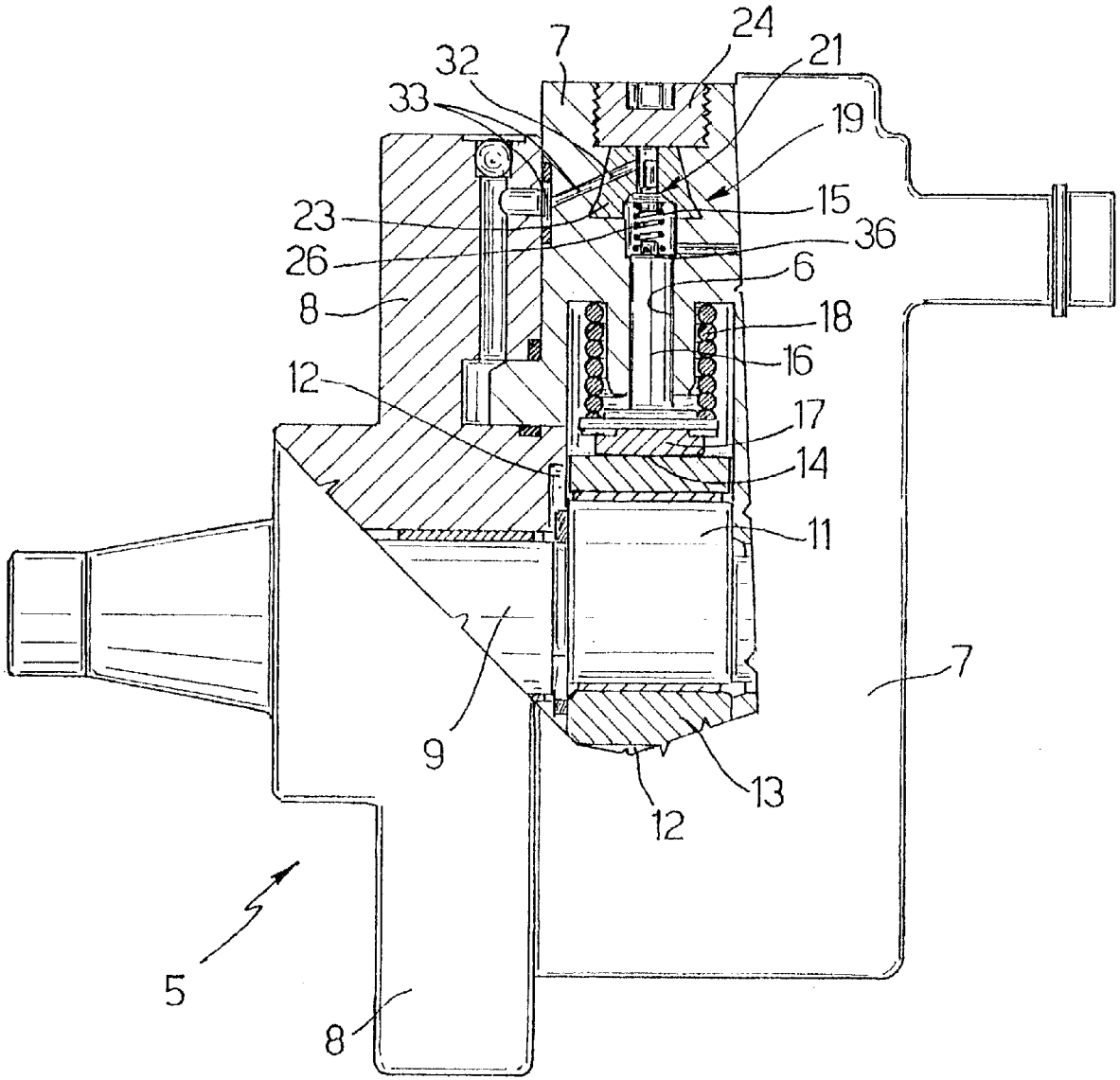
FIG. 1 shows a partially sectioned side view of a radial-piston pump in accordance with the invention.

Number 5 in FIG. 1 indicates as a whole a high-pressure pump for supplying fuel to an internal combustion engine, e.g. a diesel engine. Pump 5 is a radial-piston type, and comprises three cylinders 6—only one shown in FIG. 1—arranged radially inside a hollow body 7, with the respective axes 120° apart. More specifically, cylinders 6 are formed in one piece with hollow body 7, which is closed by a flange 8.

Pump 5 has a drive shaft 9 integral with an eccentric 11 housed in a central chamber 12 of hollow body 7. Eccentric 11 carries an annular cam for controlling pump 5 and which is defined by a ring 13 rotating on eccentric 11. The outer surface of ring 13 has three flat portions 14 associated with cylinders 6 and each perpendicular to the axis of the corresponding cylinder 6.

A respective piston 16 slides in each cylinder 6; the outer radial surface of piston 16 defines a compression chamber 15 in cylinder 6; and piston 16 projects from cylinder 6 towards shaft 9, and carries a pad 17 which slides in known manner on the corresponding portion 14 of ring 13. As shaft 9 rotates, ring 13 moves pistons 16 positively and sequentially in the compression direction, i.e. outwards. By means of a spring 18, on the other hand, pad 17 is pushed elastically, together with piston 16, in the intake direction towards the corresponding flat portion 14 of ring 13.

Figure 2:
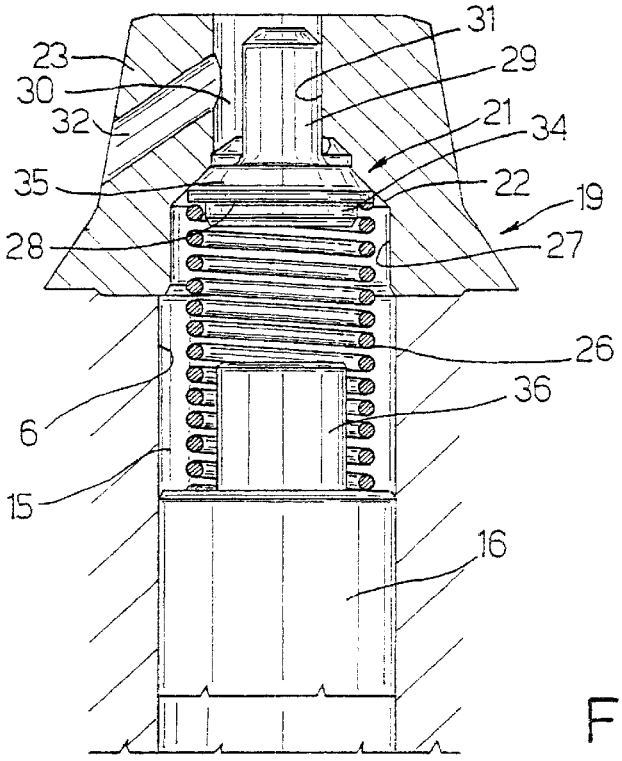
FIG. 2 shows a larger-scale detail of FIG. 1.

Each piston 16 is associated with an intake valve 19 comprising a shutter 21 cooperating with a seat 22 (FIG. 2) formed in a valve body 23 and coaxial with the corresponding cylinder 6. Valve body 23 is integral with cylinder 6 and hence with hollow body 7 (FIG. 1), and is fixed to hollow body 7 by a fluidtight ring nut fastening member 24. Each piston 16 is also associated with a delivery valve not shown in the drawings.

According to the invention, elastic means defined by a compression spring 26 are located between piston 16 and shutter 21. More specifically, valve body 23 (FIG. 2) is bell-shaped and comprises a substantially cylindrical cavity 27 facing piston 16 and housing part of spring 26. Seat 22 is located inside cavity 27 and is truncated-cone-shaped, flaring towards compression chamber 15.

Shutter 21 comprises a plate 28 integral with a stem 29, which is guided by an axial hole 31 in valve body 23; axial hole 31 has an enlargement 30 communicating with a supply conduit 32 of valve body, 23; and conduit 32 communicates with supply channels 33 (FIG. 1) carried by hollow body 7 and/or flange 8.

On the side Lacing stem 29, plate 28 has a truncated-cone-shaped edge 35 complementary in shape to that of seat 22. On the side facing away from stem 29, plate 28 carries a cylindrical projection 34 for securing one end of spring 26. The outer radial surface of piston 16 has a cylindrical appendix 36 smaller in diameter than piston 16; and the other end of compression spring 26 is secured to cylindrical appendix 36 of piston 16.

Pump 5 operates as follows.

When eccentric 11 is in the FIG. 1 position, the piston 16 shown in FIG. 1 is in the top dead center position and keeps spring 26 compressed. As shaft 9 rotates, eccentric 11, by means of ring 13, allows spring 18 to move piston 16 inwards, thus producing a depression in intake chamber 15 and also slightly decompressing or extending spring 26, which reduces the force exerted on plate 28 of shutter 21 to a value equivalent to 1.8-bar pressure on the bottom surface of plate 28.

When the difference in pressure between supply conduit 32 and compression chamber 15 is greater than the force exerted by the decompressed spring 26, intake valve 19 is opened. Intake valve 19 is thus opened promptly and in advance with respect to known valves, even in the presence of low fuel pressure or flow in supply conduit 32. Fuel is then drawn along supply channels 33 and conduit 32 in valve body 23. The force exerted by spring 26 on plate 28 of shutter 21 is reduced to minimum at the bottom dead center position of piston 16, but the fuel pressure in chamber 15 remains the same as in supply conduit 32.

Eccentric 11 then begins moving piston 16 positively outwards to begin compressing the fuel in chamber 15. Piston 16 also begins compressing spring 26, which increases the elastic force exerted on plate 28 of shutter 21, which is then closed by the fuel pressure in chamber 15 together with the force exerted by spring 26. Valve 19 is therefore closed promptly and in advance with respect to known valves, thus providing for greater compression efficiency. Compression continues until piston 16 once more reaches the top dead center position.

Figure 3:
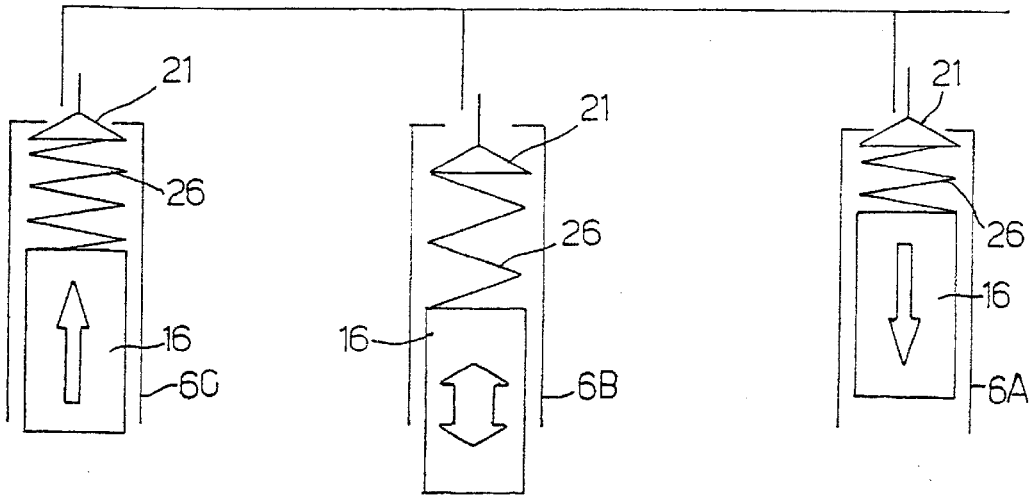
FIG. 3 shows an operating diagram of the FIG. 1 pump.

FIG. 3 shows the relative positions of the three pistons 16 and relative shutters 21 of pump 5 in the course of a typical stage in the operation of ecentric 11. In FIG. 3, the three cylinders 6 are indicated A, B and C. More specifically, in cylinder 6A, piston 16 is at the start of the intake stroke, close to the top dead center position; and, though shutter 21 is still closed, spring 26 begins extending and reducing the force exerted on shutter 21.

In cylinder 6B, piston 16 moves towards the bottom dead center position; spring 26 is only slightly compressed; and shutter 21 is opened even in the presence of low fuel pressure in supply channels 33. In cylinder 6C, piston 16 has begun the compression stroke and has also begun to compress spring 26, so that shutter 21 is closed immediately.

The advantages, as compared with the known state of the art, of the pump according to the invention will be clear from the foregoing description. In particular, shutter 21 is opened and closed more rapidly, even with low fuel pressure in the supply conduit; and operation of the pump is balanced and continuous.

Clearly, changes may be made to the pump as described herein without, however, departing from the scope of the accompanying claims. For example, cylinders 6 may be separate from, and inserted inside holes in, hollow body 7; and each valve body 23 may be fitted to hollow body 7, together with the corresponding cylinder, by means of a fastening plate.

Seat 22 of intake valve 19 may be flat as opposed to truncated-cone-shaped; and the pump may even be a single-piston or multiple-in-line-piston type, and be used for pumping fluids other than engine fuel.

What is claimed is:

1. A high-pressure hydraulic pump comprising at least one cylinder (6) in which slides a piston (16), and actuating means (9, 11) for moving said piston (16) positively in a compression direction; said piston (16) being moved elastically in an intake direction opposite to said compression direction; and an intake valve (19) comprising a shutter (21) being fitted to said cylinder (6); characterized in that elastic means (26) are provided between said piston (16) and said shutter (21) to push said shutter (21) into a closed position by exerting elastic force varying with the position of said piston (16) in said cylinder (6), so as to advance opening and closing of said intake valve (19).

2. A pump as claimed in claim 1, wherein said shutter (21) comprises a plate (28) cooperating with a seat (22) of said intake valve (19); said plate (28) being movable parallel to said piston (16); characterized in that said elastic means comprise a compression spring (26) located between said plate (28) and said piston (16).

3. A pump as claimed in claim 2, characterized in that said shutter (21) also comprises a stem (29) integral with said plate (28) and extending radially outwards; said stem being guided inside an axial hole (31) of a valve body (23) of said intake valve (19).

4. A pump as claimed in claim 3, characterized in that said seat (22) is truncated-cone-shaped, flaring towards said piston (16); said plate (28) having, on the side facing said stem, a truncated-cone-shaped edge (35) complementary to the shape of said seat (22).

5. A pump as claimed in claim 4, characterized in that said plate comprises, on the opposite side to said stem, a cylindrical projection (34) for securing one end of said spring (26).

6. A pump as claimed in claim 4, characterized in that said piston (16) has a cylindrical appendix (36)coaxial with said plate (28) and for securing another end of said spring (26).

7. A pump as claimed in claim 3, wherein said seat (22) is coaxial with said cylinder (6) 15 and is carried by a valve body (23) fitted to said cylinder (6); said valve body (23) having a supply conduit (32); characterized in that said valve body (23) is bell-shaped for housing at least part of said spring (26).

8. A pump as claimed in claim 3, characterized in that said axial hole (31) has an enlargement (30) communicating with said supply conduit (32).

9. A pump as claimed in claim 8, of the radial-piston type for internal combustion engine fuel, comprising a hollow body (7) closed by a flange (8); said hollow body (7) carrying a group of radial cylinders (6) associated with a corresponding group of pistons (16) and with a corresponding group of intake valves (19); and said pistons (16) being activated by a common eccentric (11); characterized in that each of said valve bodies (23) if fitted inside said hollow body (7) by means of a fluidtight fastening member (24); said fastening member (24) being fittable to said hollow body (7) from the outside.

10. A pump as claimed in claim 9, characterized in that the supply conduit (32) of each valve body (23) communicates with a supply channel (33) formed in said hollow body (7) and/or in said flange (8).

* * * * *